US006085921A

United States Patent [19]

Brown

[11] Patent Number: 6,085,921

[45] Date of Patent: Jul. 11, 2000

[54] TAMPER EVIDENT BAND WITH UNDERCUT

[75] Inventor: Robert Brown, Crystal Lake, Ill.

[73] Assignee: Crown Cork & Seal Technologies Corporation, Alsip, Ill.

[21] Appl. No.: 09/032,542

[22] Filed: Feb. 26, 1998

[51] Int. Cl.[7] ..... B65D 39/00

[52] U.S. Cl. ..... 215/252

[58] Field of Search ..... 215/252

[56] References Cited

U.S. PATENT DOCUMENTS

| | | | |
|---|---|---|---|
| 3,968,823 | 7/1976 | Simon . | |
| 4,156,490 | 5/1979 | Peraboni | 215/252 |
| 4,196,818 | 4/1980 | Brownbill | 215/252 |
| 4,299,328 | 11/1981 | Ochs et al. | 215/252 |
| 4,305,516 | 12/1981 | Perne et al. | 215/252 |
| 4,394,918 | 7/1983 | Grussen | 215/243 |
| 4,418,828 | 12/1983 | Wilde et al. | 215/252 |
| 4,432,461 | 2/1984 | Mumford et al. | 215/252 |
| 4,458,822 | 7/1984 | Ostrowsky | 215/252 |
| 4,478,343 | 10/1984 | Ostrowsky | 215/252 |
| 4,506,795 | 3/1985 | Herr | 215/252 |
| 4,511,054 | 4/1985 | Shank | 215/252 |
| 4,526,282 | 7/1985 | Dutt et al. | 215/252 |
| 4,545,496 | 10/1985 | Wilde et al. | 215/252 |
| 4,546,892 | 10/1985 | Couput | 215/252 |
| 4,550,844 | 11/1985 | Lininger | 215/252 |
| 4,572,388 | 2/1986 | Luker et al. | 215/252 |
| 4,592,475 | 6/1986 | Hannon et al. | 215/252 |
| 4,595,110 | 6/1986 | Herr | 215/252 |
| 4,613,052 | 9/1986 | Gregory et al. | 215/252 |
| 4,643,321 | 2/1987 | Gach | 215/252 |
| 4,657,153 | 4/1987 | Hayes . | |
| 4,666,053 | 5/1987 | Corcoran et al. | 215/252 |
| 4,691,501 | 9/1987 | King | 53/485 |
| 4,694,969 | 9/1987 | Granat | 215/252 |
| 4,732,289 | 3/1988 | Granat et al. | 215/252 |
| 4,796,770 | 1/1989 | Begley | 215/252 |
| 4,801,030 | 1/1989 | Barriac | 215/252 |
| 4,805,792 | 2/1989 | Lecinski, Jr. | 215/253 |
| 4,807,771 | 2/1989 | Roy et al. | 215/252 |
| 4,813,561 | 3/1989 | Ochs | 215/252 |
| 4,813,562 | 3/1989 | Begley | 215/252 |
| 4,846,361 | 7/1989 | Haffner | 215/252 |
| 4,848,614 | 7/1989 | Csaszar | 215/252 |
| 4,875,594 | 10/1989 | Ochs | 215/252 |
| 4,895,266 | 1/1990 | Begley | 215/230 |
| 4,971,212 | 11/1990 | Kusz | 215/252 |
| 4,978,016 | 12/1990 | Hayes | 215/252 |
| 4,981,230 | 1/1991 | Marshall et al. | 215/252 |
| 5,054,268 | 10/1991 | Hayes et al. . | |
| 5,058,755 | 10/1991 | Hayes | 215/252 |
| 5,062,538 | 11/1991 | Ochs | 215/252 X |
| 5,080,246 | 1/1992 | Hayes | 215/252 |
| 5,090,788 | 2/1992 | Ingram et al. | 215/252 |
| 5,356,019 | 10/1994 | Kelly | 215/252 |
| 5,400,913 | 3/1995 | Kelly | 215/252 |
| 5,443,171 | 8/1995 | Sprowl | 215/252 |
| 5,488,888 | 2/1996 | Kowal | 215/252 X |
| 5,660,290 | 8/1997 | Hayes | 215/252 |
| 5,727,705 | 3/1998 | Kelly | 215/252 |
| 5,755,347 | 5/1998 | Ingram | 215/252 |

FOREIGN PATENT DOCUMENTS

| | | |
|---|---|---|
| 0 593 396 | 4/1994 | European Pat. Off. . |
| 0 616 951 | 9/1994 | European Pat. Off. . |
| 0 801 005 | 10/1997 | European Pat. Off. . |
| 2 033 350 | 5/1980 | United Kingdom . |
| WO 94 14673 | 7/1994 | WIPO . |
| WO 96/11856 | 1/1996 | WIPO . |

*Primary Examiner*—Stephen K. Cronin
*Attorney, Agent, or Firm*—Woodcock Washburn Kurtz Mackiewicz & Norris LLP

[57] ABSTRACT

A closure with tamper evident band for sealing containers and the like is provided. The closure has a top, a depending tubular skirt and a frangibly connected annular tamper evident band extending coextensively from the bottom of the tubular skirt. The tamper evident band has an annular band resiliently hinged to an inwardly and upwardly projecting annular flange for engaging a locking lug on a corresponding bottle neck. The annular band and annular flange define an annular undercut cavity so that, during capping, the resiliently hinged flange swings outwardly into the annular undercut cavity to facilitate passage of the flange over the bottle neck locking lug.

12 Claims, 2 Drawing Sheets

TAMPER EVIDENT BAND WITH UNDERCUT

BACKGROUND

The present invention relates to a tamper evident band for use with closures of the type typically used to seal beverage containers, medicine bottles and the like.

Various beverages, foods, medicines and the like are delivered to the public in bottles or containers with resealable closures. Resealable closures provide a benefit to the consumer in that the containers can be tightly sealed and resealed after opening, prolonging the shelf life of the product and maintaining freshness. Although resealable containers provide benefits to consumers, they permit unauthorized and sometimes undetectable tampering with the product.

It is known to use a tamper evident band in conjunction with a closure to remedy the problems of tampering. Typical known tamper evident closures have a closure portion and a tamper evident band portion. The tamper evident band portion is frangibly connected to the closure portion. Upon removal of the closure the frangible connection breaks, leaving the tamper evident band on the bottle's neck. The broken frangible connection provides the user with visual evidence that the container has already been opened and that the container contents may have been tampered with or altered.

Various means are known to effectuate the separation of the closure and tamper evident band portions upon removal of the closure from the container neck. These designs typically utilize variations of a locking assembly, whereby, the tamper evident band portion has an internally projecting annular flange which engages an externally projecting locking lug of a bottle neck. The flange and locking lug are sized so that the flange has an inside diameter slightly smaller than the outside diameter of a locking lug. In this respect, with the flange disposed below the locking lug, the locking lug creates a barrier to passage of the flange when the closure is unscrewed. As the closure is unscrewed the flange cannot pass the barrier, causing the frangible connection to yield and the tamper evident band to separate from the closure.

Although the barrier created by the locking lug and the flange creates the necessary means for breaking the frangible connection, during capping the barrier is problematic since the flange must be forced over it. The force and torque required to snap the flange over the locking lug barrier during capping frequently destroys the frangible connection, separating the tamper evident band from the closure and causing it to lose its tamper indicating function.

It is known in the art to alleviate this problem by tapering or rounding the lower portion of the flange or the upper surface of the locking lug to reduce the force required to urge the flange over the locking lug during capping. In this way, the inclined or rounded surfaces facilitate the expansion of the flange over the lug during sealing but not during removal.

Although the known contouring facilitates capping, the torque and force required to snap the annular flange over the bottle neck lug is still often sufficient to destroy the frangible connection on the tamper evident band. These persistent capping defects lead to high packaging cost through product waste and lost time as failed closures are removed and replaced.

For the foregoing reasons, there is a need for a closure with tamper evident band wherein the torque and force required to install the band is reduced such that failures of the frangible connection can be minimized during capping.

SUMMARY OF THE INVENTION

The invention herein solves these problems by providing a closure with tamper evident band which requires significantly less torque and force to snap the annular flange of the tamper evident band over the bottle neck locking lug during capping.

It is the primary object of the present invention to provide a tamper evident band, whereby the tamper evident band comprises an annular band and an annular flange. The annular flange is disposed along the inside circumference of the annular band. The annular flange may comprise a plurality of individual flange segments or may be substantially continuous around the inside circumference of the annular band.

The annular band and flange are arranged to form a v-shaped cross section. The annular band being one arm of the "v" and the flange being the other arm of the "v". The upper portion of the annular band is frangibly connected to the annular skirt of the closure. The annular band and flange are resiliently hinged at their lower portions. The flange extends from its resiliently hinged lower portion, inwardly and upwardly to its upper portion. The inside wall of the annular band and the outside wall of the inwardly and upwardly extending annular flange, define an annular undercut cavity.

During capping, the bottle neck locking lug engages the inwardly directed annular flange and urges the flange to swing outwardly toward the annular band and into the annular undercut cavity. In this way, the inside diameter of the flange expands and allows the flange to easily pass over the locking lug. Once passed the locking lug, the resilient hinged connection of the flange urges the flange out of the cavity and back to its resting v-shaped position. In this position, the flange portion is disposed under the locking lug of the bottle neck.

When the closure is subsequently removed, the flange is force against the underside of the bottle neck locking lug. In this direction, the flange can not pass the locking lug. Accordingly, the frangible connection yields, separating the tamper evident band from the closure as the closure is unscrewed.

These and other features, aspects and advantages of the present invention will become better understood with regard to the following description, appended claims, and accompanying drawings.

DETAILED DESCRIPTION

Figure 1:
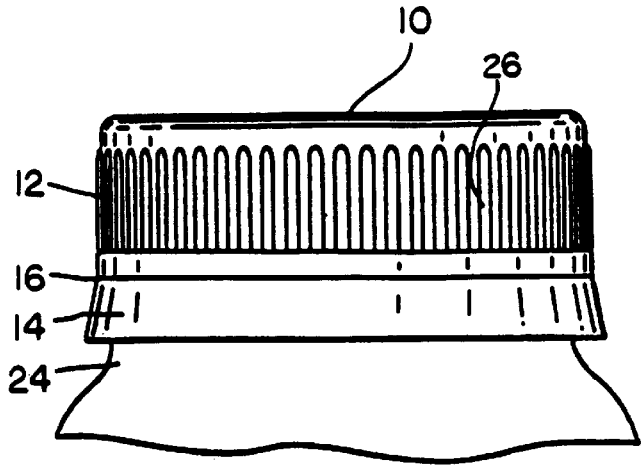
FIG. 1 shows a side elevation view of the closure with tamper evident band.

Referring to FIGS. 1–6, an integrally molded plastic closure with tamper evident band is provided for sealing soda, water, medicine bottles and the like. In FIGS. 1–6 the closure with tamper evident band is shown having a top portion 10, a depending tubular skirt 12 extending therefrom, and a depending frangibly connected annular tamper evident band 14 comprising an annular band 28 and an annular flange 30.

Referring to FIGS. 2–6, the tubular skirt 12 has an inwardly extending screw thread 20 on its interior annular surface. The screw thread spacing is adapted to interengage a corresponding outwardly extending screw thread 22 on the exterior annular surface of a bottle neck 24.

The exterior annular surface of the depending tubular skirt can incorporate a knurled finish or grip enhancers 26. The grip enhancers 26 are shown as nodules protruding from the tubular skirt 12, and may be vertical and equally spaced, or angled, horizontal, and variably spaced.

A depending frangible connection 16 extends from the tubular skirt 12 and joins the annular band 28 of the tamper evident band 14. The frangible connection 16 is preferably of weakened plastic and defines a continuous circumferentially engaging annular ring or a plurality of circumferentially distributed tabs.

The annular band 28 and the annular flange 30 each have upper and lower portions. The upper portion of the annular band 28 depends from the frangible connection 16. The lower portion of the annular band 28 is resiliently hingedly connected, along its inside circumference, to the outside circumference of the lower portion of the annular flange 30. The annular flange 30 projects inwardly and upwardly from its lower portion toward its upper portion. The resiliently hinged annular band 28 and annular flange 30 form a v-shaped cross-section and define the walls of an annular undercut cavity 32. The annular undercut cavity 32 is sized to receive the annular flange 30.

The annular flange 30 is sized to have an inside diameter at its lower portion which is substantially equal to the outside diameter of the bottle neck locking lug 34. At its top portion, the annular flange in its relaxed position is sized to have a diameter smaller than the outside diameter of the corresponding bottle neck locking lug 34 and substantially equal to the diameter of the bottle neck 24.

Figure 5:
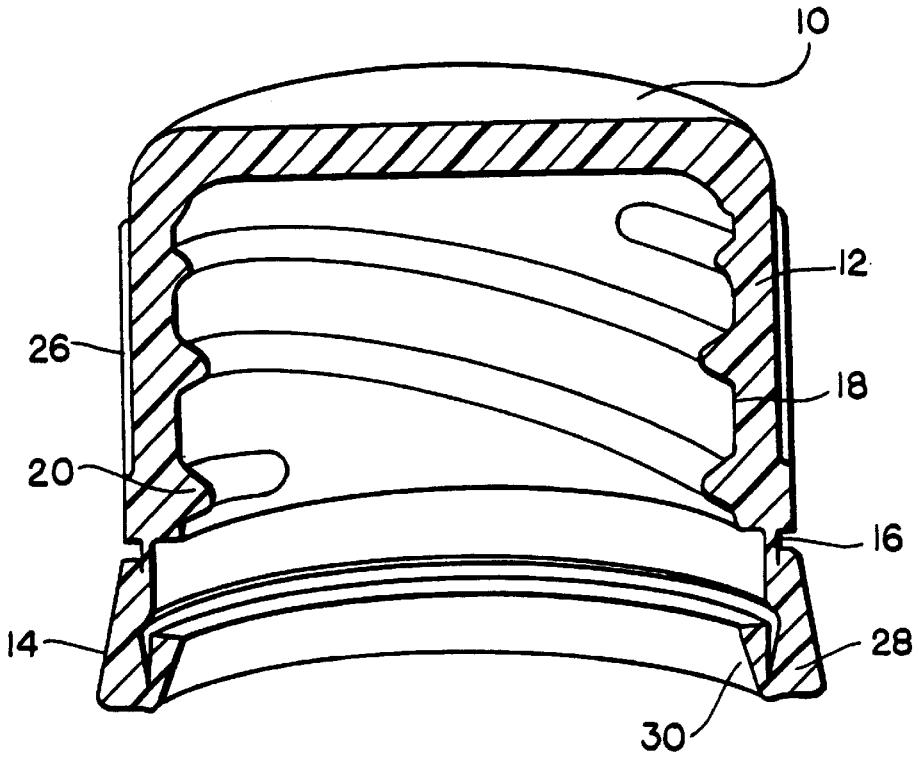
FIG. 5 shows a cross-sectional perspective view of the closure with tamper evident band.
Figure 6:
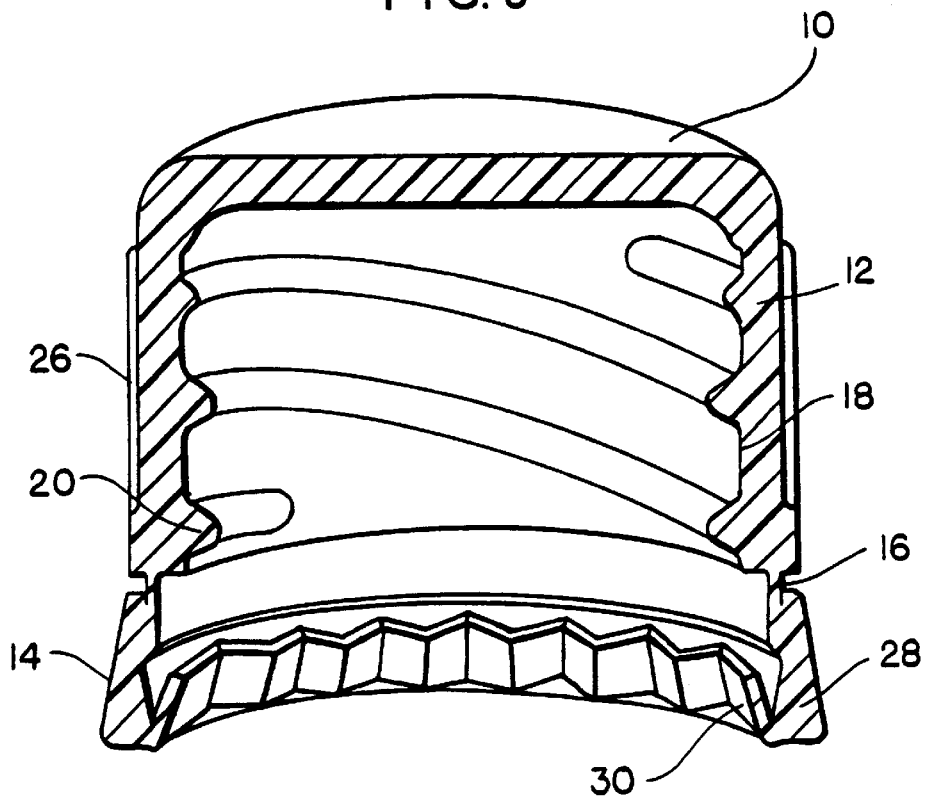
FIG. 6 shows a cross-sectional perspective view of an alternate embodiment of the closure with tamper evident band.

Referring to FIG. 5, the annular flange 30 may be continuous around the circumference of the annular band. Alternatively, referring to FIG. 6, the flange may comprise a plurality of individual flange segments distributed around the circumference of the annular band. Where the annular flange has been segmented, it is preferable to fold the edges of each segment outwardly, so they do not catch on the locking lug during capping. flange 30, and the annular undercut cavity 32 of the tamper evident band 14 facilitates the urging of the annular flange 30 passed the bottle neck locking lug 34.

Figure 2:
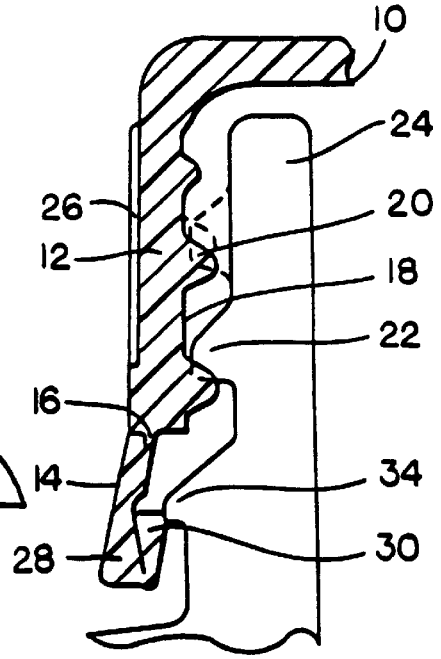
FIG. 2 shows a cross-sectional view of the closure with tamper evident band as the annular flange passes over the bottle neck locking lug during sealing.
Figure 3:
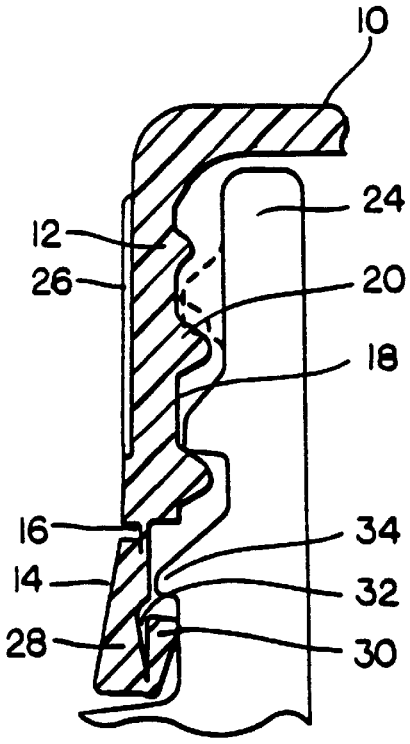
FIG. 3 shows a cross-sectional view of the closure with tamper evident band sealing a bottle.

During capping, as shown in FIG. 2, the annular flange 30 is urged outwardly by the bottle neck locking lug 34. The resiliently hinged connection between the annular band 28 and the annular flange 30 permits the annular flange 30 to move outwardly into the undercut cavity 32, with relatively little force and torque. Once the annular flange 30 passes the bottle neck locking lug 34, as shown in FIG. 3, the resiliently hinged connection urges the annular flange 30 against the bottle neck 24 and under the locking lug 34.

Figure 4:
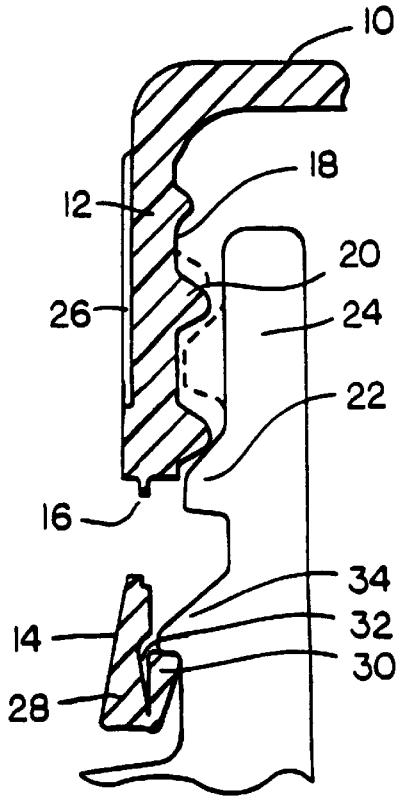
FIG. 4 shows a cross-sectional view of the closure with tamper evident band with the tamper evident band separated from the closure.

When the tamper evident closure is subsequently removed, as shown in FIG. 4, the upper portion of the annular flange 30 is forced against the underside of the bottle neck locking lug 34. As the closure continues to be removed, the frangible connection 16 yields, separating the tamper evident band 14 from the closure.

Although a single preferred embodiment of the invention has been disclosed in detail herein, it should be understood that this invention is in no sense limited thereby and its scope is to be determined by that of the claims.

What is claimed is:

1. A closure with tamper evident band for sealing a bottle, comprising:

a top;

a tubular skirt depending from the top;

a tamper evident band depending from the tubular skirt, the tamper evident band comprising an annular band having an upper and lower portion and an annular flange having an upper and lower portion, the upper portion of the annular band being frangibly connecting to the tubular skirt, the lower portion of the annular band being resiliently hingedly connected to the lower portion of the annular flange, the annular flange extending from its lower portion to its upper portion in an inward and upward direction, so that in its relaxed position, the annular flange and the annular band define the walls of an annular undercut cavity spacing the upper portion of the annular flange from the annular band, the undercut cavity having a larger diameter than at least a portion of the annular band, whereby the annular band can readily expand outwardly into the annular undercut cavity as the annular flange passes over a bottle neck locking lock during capping, wherein the diameter of the undercut cavity is larger than a diameter of an inside surface of the annular band upper portion.

2. The closure with tamper evident band according to claim 1 wherein the annular flange is continuous around the circumference of the annular band.

3. The closure with tamper evident band according to claim 1 wherein the annular flange comprises a plurality of annular flange segments distributed around the annular band.

4. The closure with tamper evident band according to claim 3 wherein the edges of the plurality of segments are turned outward toward the band so that the edges do not catch on the locking lug during capping.

5. The closure with tamper evident band according to claim 1 wherein the closure with tamper evident band is formed from plastic.

6. The closure with tamper evident band according to claim 1 wherein the tubular skirt further includes threads for securing the closure to a bottle.

7. The closure with tamper evident band according to claim 1 wherein the tubular skirt further includes grip enhancers.

8. The closure of claim 1 wherein the annular undercut cavity is defined between the annular flange and an inside surface of the annular band lower portion.

9. The closure of claim 1 wherein the annular band has an inside wall that is undercut intermediate the annular band to form at least a portion of the undercut cavity.

10. The closure of claim 9 wherein the portion of the undercut cavity has a diameter that is larger than the inside wall proximate the annular band lower portion.

11. A closure with tamper evident band for sealing a bottle, comprising:

a top;

a tubular skirt depending from the top;

a tamper evident band depending from the tubular skirt, the tamper evident band comprising an annular band having an upper and lower portion and an annular flange having an upper and lower portion, the upper portion of the annular band being frangibly connecting to the tubular skirt, the lower portion of the annular band being resiliently hingedly connected to the lower portion of the annular flange, the annular flange extending from its lower portion to its upper portion in an inward and upward direction, so that in its relaxed position, the annular flange and the annular band define the walls of an annular undercut cavity spacing the upper portion of the annular flange from the annular band, the undercut cavity having a larger diameter than at least a portion of the annular band, whereby the annular band can readily expand outwardly into the annular undercut cavity as the annular flange passes over a bottle neck locking lock during capping, wherein an inside surface of the annular band upper portion has a diameter that is smaller than a diameter of a deepest portion of the undercut cavity.

12. A closure with tamper evident band for sealing a bottle, comprising:

a top;

a tubular skirt depending from the top;

a tamper evident band depending from the tubular skirt, the tamper evident band comprising an annular band having an upper and lower portion and an annular flange having an upper and lower portion, the upper portion of the annular band being frangibly connecting to the tubular skirt, the lower portion of the annular band being resiliently hingedly connected to the lower portion of the annular flange, the annular flange extending from its lower portion to its upper portion in an inward and upward direction, so that in its relaxed position, the annular flange and the annular band define the walls of an annular undercut cavity spacing the upper portion of the annular flange from the annular band, the undercut cavity having a larger diameter than at least a portion of the annular band, whereby the annular band can readily expand outwardly into the annular undercut cavity as the annular flange passes over a bottle neck locking lock during capping, wherein the portion of the undercut cavity has a diameter that is larger than the inside wall proximate the annular band upper portion and wherein the annular band has an inside wall that is undercut intermediate the annular band to form at least a portion of the undercut cavity.

* * * * *